US005828353A

United States Patent [19]

Kishi et al.

[11] Patent Number: 5,828,353

[45] Date of Patent: Oct. 27, 1998

[54] DRIVE UNIT FOR PLANAR DISPLAY

[75] Inventors: Tomokatsu Kishi; Kyoji Kariya; Tadatsugu Hirose; Shigetoshi Tomio; Yoshimasa Awata, all of Kawasaki; Shigeki Kameyama; Kazuo Yoshikawa, both of Satsuma-gun; Akira Otsuka, Kawasaki, all of Japan

[73] Assignee: Fujitsu Limited, Kawasaki, Japan

[21] Appl. No.: 667,515

[22] Filed: Jun. 21, 1996

[30] Foreign Application Priority Data

May 31, 1996 [JP] Japan ..... 8-138993

[51] Int. Cl.[6] ..... G09G 3/20

[52] U.S. Cl. ..... 345/55; 345/60; 345/76; 345/87

[58] Field of Search ..... 345/55, 60, 76, 345/87

[56] References Cited

U.S. PATENT DOCUMENTS

| | | | |
|---|---|---|---|
| 4,070,600 | 1/1978 | Butler et al. | 345/60 |
| 4,070,663 | 1/1978 | Kanatani et al. | 340/324 M |
| 4,180,762 | 12/1979 | Weber | 345/60 |
| 4,626,072 | 12/1986 | Clerc et al. | 345/60 |
| 4,866,349 | 9/1989 | Weber et al. | 314/169.4 |
| 5,049,865 | 9/1991 | Nakamura et al. | 345/60 |
| 5,081,400 | 1/1992 | Weber et al. | 315/169.4 |
| 5,093,654 | 3/1992 | Swift et al. | 345/60 |
| 5,227,696 | 7/1993 | Asars | 345/60 |

FOREIGN PATENT DOCUMENTS

| | | |
|---|---|---|
| 5-265397 | 10/1993 | Japan . |
| 7-160219 | 6/1995 | Japan . |

OTHER PUBLICATIONS

Weber et al., "A new Gas Discharge Logic Technique that Reduces Circuit Complexity for AC Plasma Display Panels," *Japan Display '83,* pp. 502–505.

Higgins, Marvin L., "A Low–Power Drive Scheme for AC TFEL Displays," *Society for Information Displays, SID '85 Digest,* pp. 226–228.

Weber et al., "Independent Sustain and Address Technique for the ac Plasma Display Panel," *Society for Information Displays, SID '86 Digest,* pp. 220–223.

*Primary Examiner*—Richard A. Hjerpe
*Assistant Examiner*—Tracy H. Nguyen
*Attorney, Agent, or Firm*—Staas & Halsey

[57] ABSTRACT

A triple-electrode planar display capable of achieving further power saving has been disclosed. A drive unit is dedicated to a planar display having a display panel in which cells being arranged in the form of a matrix and having a memory function and discharge glow function are formed, in which one of each pair of electrodes on the same substrate which are responsible for discharge glow is a common electrode connected in common. The drive unit includes a common electrode drive circuit for applying an alternating voltage to the common electrode, and a power save circuit that when the common electrode is changed from a high potential to a low potential, restores and accumulates power applied to the common electrode, and that when the common electrode is changed from the high potential to the low potential, applies accumulated power to the common electrode. The power save circuit includes a restoration channel that includes a capacitive element and inductance element and that restores power, and an application channel that includes an inductance element and that applies accumulated power to the common electrode.

15 Claims, 12 Drawing Sheets

DRIVE UNIT FOR PLANAR DISPLAY

BACKGROUND OF THE INVENTION

1. Field of the Invention

The present invention relates to a drive unit for a planar display such as a plasma display (PDP display) or electroluminescent display (EL display). More particularly, this invention is concerned with a drive unit for a planar display which realizes a fast line-sequential scanning technique with a low power consumption at low cost.

2. Description of the Related Art

In recent years, there has been an increasing demand for a planar matrix display such as a PDP display, liquid-crystal display (LCD), or EL display in place of a CRT due to the advantage of its thin appearance. In particular, the demand for a color display is growing these days.

In the past, a planar display or flat panel display, which is represented by a plasma display, EL display, or the like, has enjoyed a rapidly expanding range of applications and an increasing production scale thanks to its small depth and large display screen.

This kind of planar display is, in general, designed to achieve display through discharge glow in which charges accumulated over electrodes are released with application of a given voltage. The general principles of display will be outlined below by taking a plasma display for instance and discussing the structure and operations of the plasma display.

A plasma display (AC type PDP display) that has been well-known in the past falls into a dual-electrode type in which two kinds of electrodes are used for selective discharge (addressing discharge) and sustaining discharge and a triple-electrode type in which the third electrode is used for addressing discharge.

By contrast, a plasma display (PDP display) capable of color display is designed to excite phosphors formed in discharge cells by means of ultraviolet rays stemming from discharge. The phosphors has a drawback of being susceptible to impact of ions that are positive charges also stemming from discharge. The dual-electrode type has such a structure that the phosphors are directly hit by ions. This leads to a possibility of inviting a reduction in service lives of the phosphors. For avoiding this, the color plasma display generally adopts the triple-electrode structure using surface discharge.

Even in the triple-electrode type, the third electrode may be formed on a substrate on which the first and second electrodes responsible for sustaining discharge are arranged, or may be mounted on another substrate opposed to the substrate having the first and second electrodes. Even in the case in which the three kinds of electrodes are formed on the same substrate, the third electrode may be placed on the two kinds of electrodes responsible for sustaining discharge or may be placed under the two kinds of electrodes. Furthermore, visible light emanating from phosphors may be seen being transmitted by the phosphors or may be seen being reflected therefrom.

The foregoing types of plasma displays share the same principles. A description will therefore be made by taking for instance a planar display in which the first and second electrodes responsible for sustaining discharge are placed on the first substrate and the third electrode is formed on the second substrate opposed to the first substrate.

In a PDP display, charges are accumulated on cells according to display data, and a sustaining discharge pulse is applied to paired electrodes in order to initiate discharge glow for display. Electrodes forming each cell are opposed to one another with a dielectric serving as a coat membrane and discharge space between them, and form a capacitive element. When it says that a pulse is applied to paired electrodes, it implies that a voltage to be applied to each capacitive element is varied and the polarity of the voltage is reversed. As far as the PDP display is concerned, it is required to apply a voltage of up to about 200 V as a radio-frequency pulse to paired electrodes. In particular, a model for performing gray-scale display according to a technique of subframe display adopts a pulse duration of several microseconds. Since such a high-voltage radio-frequency signal is used for driving, the PDP display usually needs a large power consumption. Power saving is therefore sought for.

U.S. Pat. No. 4,070,663 has disclosed a control method in which an inductance element for constituting a resonant circuit together with a capacitor that is a display unit is included in order to reduce the power consumption of the capacitive display unit such as an EL (electroluminescent) display.

U.S. Pat. No. 4,886,349 and U.S. Pat. No. 5,081,400 have disclosed a sustaining (sustaining discharge) driver and address driver for a PDP having a power save circuit that includes an inductance element.

What has been disclosed by the foregoing prior arts is a dual-electrode type display unit. No mention is made of a triple-electrode display unit.

Japanese Unexamined Patent Publication (Kokai) No. 7-160219 has disclosed a configuration in which two inductors; an inductor for forming a restoration channel that restores power applied when Y electrodes are changed from a high potential to a low potential, and an inductor for forming an application channel that applies accumulated power when the Y electrodes are changed from a low potential to a high potential are included in a triple-electrode display unit. Since the power save circuit is thus composed of the two channels; the restoration channel and application channel, power can be saved highly efficiently. This enables further power saving.

The configuration disclosed in the Japanese Unexamined Patent Publication (Kokai) No. 7-160219 enables further power saving. Nevertheless, more intense power saving is requested.

SUMMARY OF THE INVENTION

An object of the present invention is to promote further power saving by merely adding a simple arrangement to a drive unit for a triple-electrode type planar display.

A drive unit for a triple-electrode type planar display in accordance with the present invention is a drive unit for a planar display having a display panel in which: two substrates having electrodes on the surfaces thereof are arranged with a given space between them so that the electrodes will be orthogonal and opposed to each other; a plurality of intersections formed by the electrodes form cells that constitute pixels and that are arranged in the form of a matrix; and is formed with an electrode formed on one of two substrates and a pair of electrodes formed on the other substrate and designed for discharge glow; and one of the pair of electrodes is a common electrode that is connected in common. In order to accomplish the foregoing object, a common electrode drive circuit and power save circuit are divided into two channels; a restoration channel and application channel. An inductance element is connected on each of the channels. The inductance element constitutes a resonant circuit together with a capacitor that is a panel.

It is preferable to include a dual-system power save circuit on the side of scan electrodes. A scan drive circuit for driving an associated scan electrode may be of a floating type in which a driving switch is interposed between the scan electrode and a restoration channel or application channel and a diode is placed in parallel with the driving switch, or of a diode mixing type in which a diode alone is connected between the scan electrode and the restoration channel or application channel, and the driving switch is connected between the scan electrode and another power terminal.

As described in U.S. Pat. Nos. 4,070,663, 4,866,349, and 5,081,400, when a power save circuit includes one system, a variation of a voltage applied to a coil is smoothened due to the parasitic capacitors of two transistors which alternately operate as a switch for switching an electrode over to a capacitive element for accumulating restored power or to a channel linked to the electrode alternately. Power cannot therefore be restored sufficiently. By contrast, according to the present invention, a power save circuit is divided into two channels; a restoration channel and application channel. The parasitic capacitor of one of two transistors operating as switches does not affect the switching speed of the other transistor on the other channel. What affects the switching speed is only the parasitic capacitor of the one transistor operating as a switch on a channel concerned. This results in the halved influence of the parasitic capacitor and the accordingly improved switching speed. Consequently, the potential at an X electrode can be raised or lowered sufficiently. Eventually, a power loss can be reduced.

If the switching speed is too low, discharge starts before the voltage of a cell reaches a voltage level set by clamping. This poses a problem that part of charges accumulated over one electrode does not move to the other electrode and becomes a loss. When such discharge is repeated, wall charges decrease in number. This causes a decrease in discharge strength. From this viewpoint, the switching speed has a significant meaning.

A current that flows with switching of the potential at an electrode is expressed as the differential of a voltage relative to a time. The more violent a variation is, the larger the flowing current becomes. A power save circuit, drive circuits, and electrodes each have a resistance. The power consumption due to a resistance is proportional to the second power of a current. The higher a switching speed at which the potential at an electrode is changed is, the larger a power consumption due to a resistance is. It is therefore required to determine the switching speed, at which the potential at an electrode is changed, in consideration of two mutually contradictory factors. When a power save circuit is composed of two channels and the channels each include an inductance element as they are in the present invention, if inductance elements having different inductances are used, it is possible to change switching speeds between power restoration and application. An optimal condition can therefore be set for each channel. Eventually, the efficiency in power save improves.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Before proceeding to a detailed description of the preferred embodiments of the present invention, a conventional PDP display will be described below to allow a clearer understanding of the differences between the present invention and the prior art.

Figure 1:
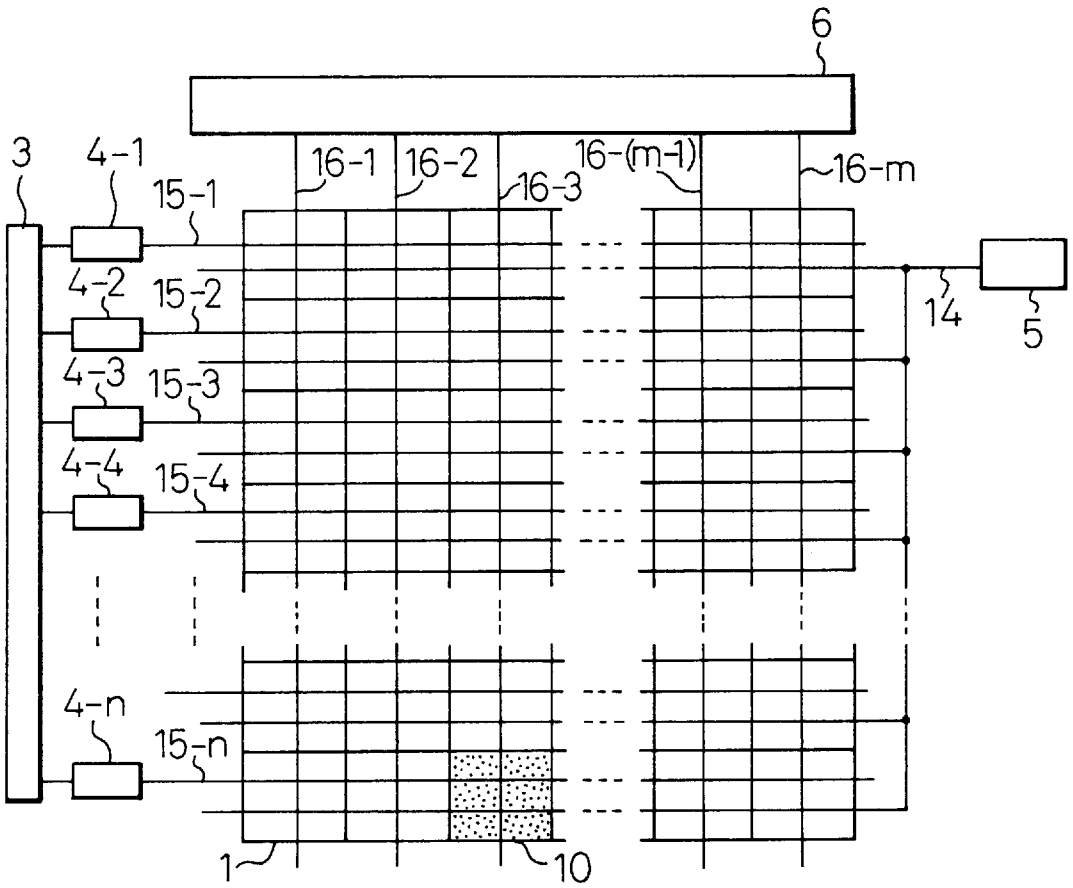
FIG. 1 is a plan view for explaining the outline of the configuration of a planar display.
Figure 2:
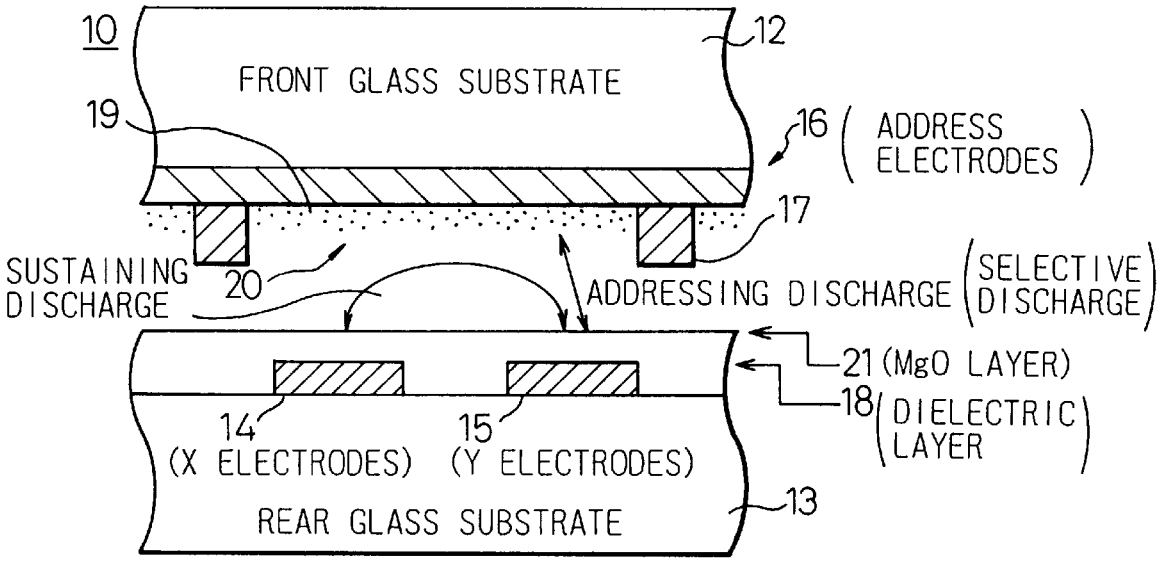
FIG. 2 is a sectional view showing an example of a structure of a cell employed in a PDP display typical of a planar display.

FIG. 1 is a plan view showing an example of the configuration of a conventional plasma (PDP) display. FIG. 2 is a schematic sectional view of one discharge cell 10 formed in the PDP display shown in FIG. 1. In the drawings, the same functional parts are assigned the same reference numerals. Part of the description of the parts will be omitted.

As shown in FIGS. 1 and 2, a PDP display is composed of two glass substrates 12 and 13. The first substrate 13 has a first electrode (X electrode) 14 and second electrode (Y electrodes) 15 which operate as sustaining electrodes juxtaposed mutually. The electrodes are coated with a dielectric layer 18. A coat 21 made of magnesium oxide (MgO) or the like is formed as a protective membrane on a discharge side formed with the dielectric layer 18.

On the surface of the second substrate 12 opposed to the first glass substrate 13, a third electrode or electrodes 16 operating as address electrodes are formed to be orthogonal to the X electrode 14 and Y electrodes 15. Phosphors 19 having the characteristic of glowing in red, green, or blue is located on the address electrodes 16. Walls 17, which are formed on the same side of the second substrate 12 as the one on which the address electrodes are located, define discharge spaces 20. In other words, discharge cells 10 in a plasma display are partitioned by the walls (barriers).

The first electrode (X electrode) 14 and second electrode (Y electrodes) 15 are juxtaposed mutually and paired. The second electrode (Y electrodes) 15 is driven by respective Y electrode drive circuits 4-1 to 4-n which are connected to a Y electrode driving common drive circuit 3. The first electrode (X electrode) 14 is a common electrode and driven by a single drive circuit 5.

The address electrodes 16-1 to 16-m are arranged orthogonally to the X electrode 14 and Y electrodes 15, and connected to an address drive circuit 6. The address electrodes 16 are connected one by one to the address drive circuit 6, and applied an addressing pulse used for addressing discharge by the address drive circuit 6.

The Y electrodes 15 are connected independently to Y scan drivers 4-1 to 4-n. The scan drivers 4-1 to 4-n are connected to the Y common drive circuit 3. For addressing discharge, a pulse is generated by the scan drivers 4-1 to 4-n. A sustaining discharge pulse or the like is generated by the Y common drive circuit 3 and applied to the Y electrodes 15 via the Y scan drivers 4-1 to 4-n.

The X electrode 14 is connected in common over all display lines in a panel, and driven. That is to say, an X electrode common drive circuit 5 generates a writing pulse, sustaining pulse, and the like and applies them concurrently to the Y electrodes 15.

The X electrode common drive circuit 5 and Y electrode common drive circuit 3 drive the X electrode 14 and Y electrodes respectively while reversing the polarity of a voltage to be applied alternately to the X electrode 14 and Y electrodes, whereby sustaining discharge is executed.

The drive circuits are controlled by a control circuit that is not shown. The control circuit is controlled with synchronizing (hereinafter sync) signals and a display data signal which are input externally of the display.

Figure 3:
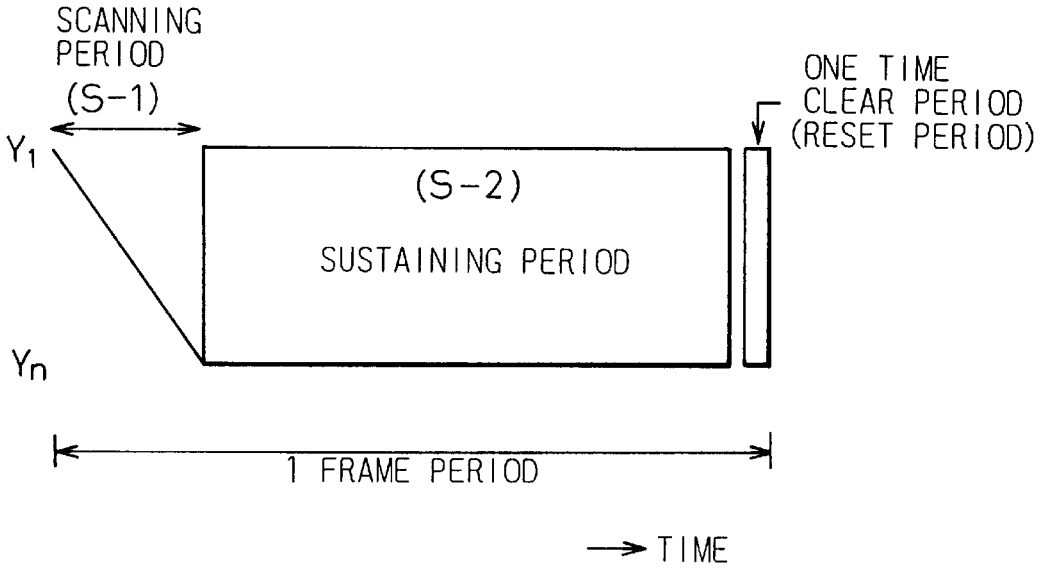
FIG. 3 is a diagram for explaining an example of a driving method for a planar display.
Figure 4:
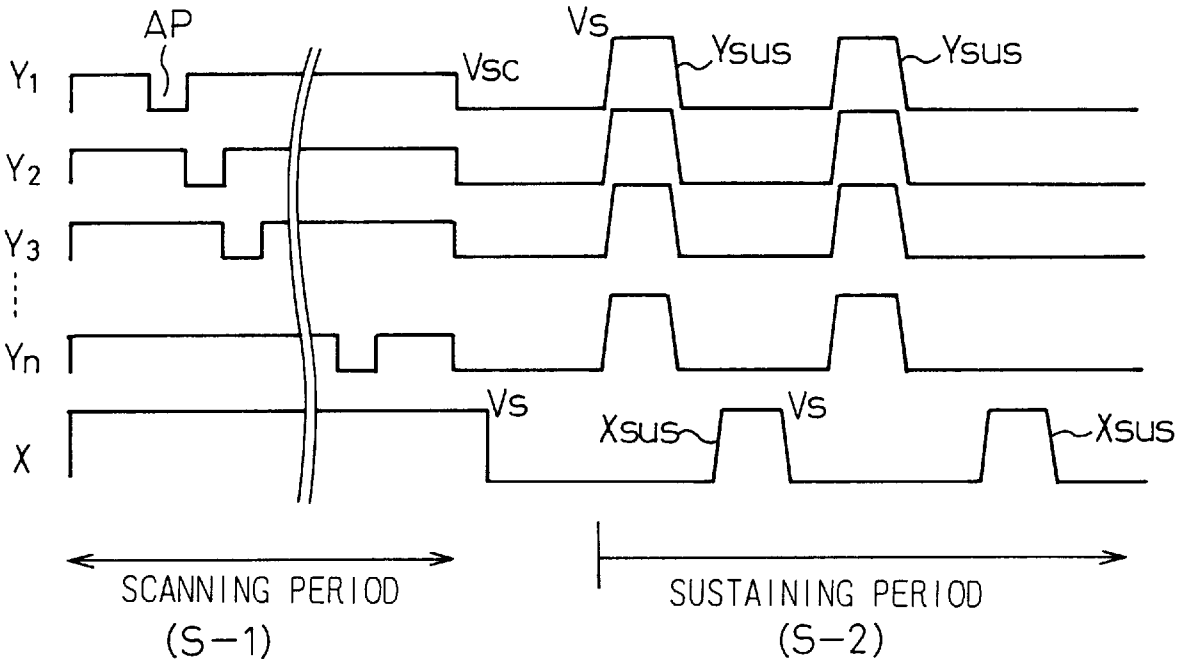
FIG. 4 is a diagram showing examples of driving voltage waves used to operate a planar display.

FIG. 3 is a diagram showing the structure of a basic driving cycle in the PDP display. FIG. 4 shows driving waves to be applied during the basic driving cycle. Referring to FIGS. 3 and 4, a driving method for the PDP display will be described.

A PDP display displays a display screen while rewriting it in units of a given cycle. One display cycle is referred to as a frame. One frame is, as shown in FIG. 3, composed of a scanning addressing period S-1 during which cells are set to states corresponding to display data, a sustaining discharge period S-2 during which cells set to a glowing state are discharged to glow, and a one-time clear period during which all the cells are set to the same state. For gray-scale representation, generally, one frame is divided into a plurality of subframes having sustaining discharge periods of different lengths, and a combination of subframes during which glowing is enabled is determined for each cell. Even in this case, each subframe is, as shown in FIG. 3, composed of a scanning period S-1, sustaining discharge period S-2, and one-time clear period. The subframe structure has no direct relation to the present invention. Herein, a description will therefore be made on the assumption that one frame has the structure shown in FIG. 3.

During a scanning addressing period, first, a scanning signal is supplied from the Y electrode scan drive circuit 4-1 to a Y electrode 15-1. A signal corresponding to display data coincident with the first scan line formed with the Y electrode 15-1 is supplied in the form of addressing pulses AP to the address electrodes 16-1 to 16-m. Cells 10 associated with data to be displayed are discharged transiently. Wall charges of a given magnitude are accumulated on each of the cells. Thus, the cells exert a memory function. Likewise, the Y electrode scan drive circuits 4-2, 4-3, etc., and 4-n are actuated in that order so that the Y electrodes 15-2 to 15-n can be scanned line-sequentially. Thus, data to be displayed is written in given cells.

When the scanning addressing period S-1 comes to an end, the sustaining discharge period S-2 starts. A given voltage Ysus is applied simultaneously to the Y electrodes of all the cells 10, which constitute a display panel and are formed at intersections between the Y electrodes 15-1 and 15-n and X electrode 14, by the Y electrode common drive circuit 3. Thereafter, a voltage Xsus having the opposite polarity of that of the voltage Ysus is applied to the X electrode by the X electrode common drive circuit 5. Thus, an alternating voltage is applied alternately to the electrodes of each cell 10.

At this time, only cells 10, to which display data has been applied during the scanning addressing period and on which wall charges of a given magnitude are accumulated, are discharged to glow repeatedly a given number of times.

In a conventional planar display, generally, an initialization period is set in order to clear remaining wall charges which have been accumulated in cells that are discharged to glow during the immediately previous sustaining discharge period during which an alternating voltage is applied to all the cells 10 by the Y electrode common drive circuit 3 and X electrode common drive circuit 5. For the initialization period, a method of clearing charges line-sequentially in units of a display line may be adopted. Alternatively, a method of clearing charges from all display lines at a time may be used. The one-time clear period in FIG. 3 refers to a period during which charges are cleared from all the display lines at a time.

As mentioned above, a PDP display achieves display by accumulating charges on cells according to display data, and applying a sustaining discharge pulse to paired electrodes for sustaining discharge. Electrodes constituting each cell are opposed to each other with a dielectric that is a coat membrane and a discharge space, and constitute a capacitive element. When it says that a pulse is applied to paired electrodes, it implies that a voltage to be applied to each capacitive element is varied and the polarity of the voltage is reversed.

It is necessary for a PDP display to apply a voltage of up to about 200 V as a radio-frequency pulse to paired electrodes. In particular, a model designed to perform gray-scale display according to a subframe display technique adopts a pulse duration of several microseconds. Since such a high-voltage radio-frequency signal is used for driving, the PDP display generally requires a large power consumption. Power saving is therefore in earnest need.

As already described, the U.S. Pat. Nos. 4,070,663, 4,866,349, and 5,081,400, and Japanese Unexamined Patent Publication (Kokai) No. 7-160219 have disclosed conventional displays from the viewpoint of power save.

Figure 5:
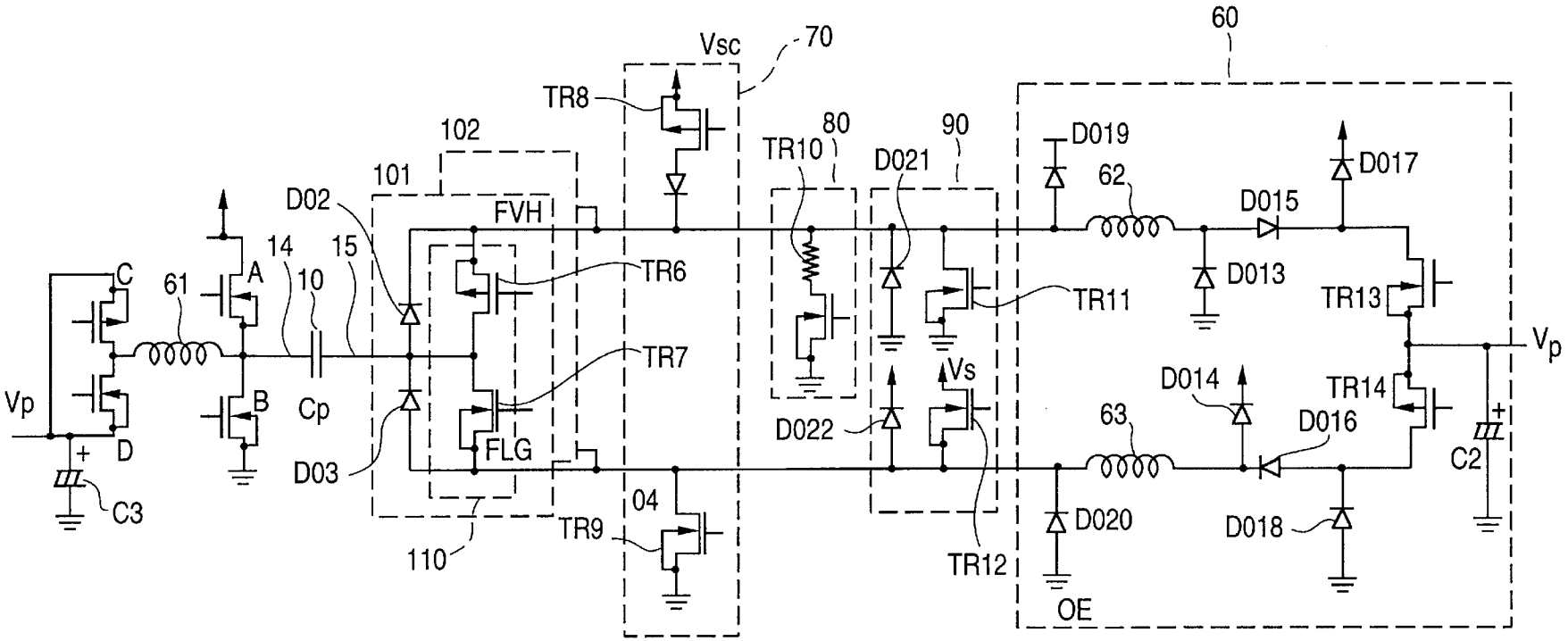
FIG. 5 (PRIOR ART)
FIG. 5 is a diagram showing the circuitry of a conventional power save circuit.

FIG. 5 is a diagram showing the circuitry of a conventional display disclosed in the Japanese Unexamined Patent Publication No. 7-160219 in which two power save inductors are connected to Y electrodes. A power save circuit is composed of two channels; a restoration channel and application channel. Owing to this circuitry, power can be saved more efficiently. Eventually, further power saving can be achieved.

Problems occurring when a power save circuit has one channel as the ones described in the U.S. Pat. Nos. 4,070,663, 4,866,349, and 5,081,400 will be described briefly.

A single-system power save circuit is, for example, a power save circuit having the conventional circuitry shown in FIG. 5 and being connected to the X electrode. This circuit comprises a coil 61 being connected to the X electrode 14 and operating as an inductance element, a capacitor C3 operating as a capacitive element, and a pair of transistors C and D connected between the coil 61 and capacitor C3.

Figure 6A:
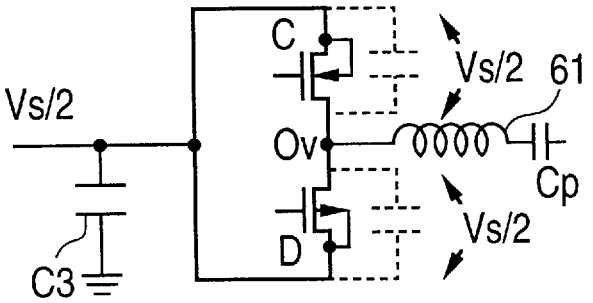
FIG. 6A (PRIOR ART)
FIGS. 6A to 6C are diagrams for explaining a problem lying in a power save circuit having one channel.
Figure 6B:
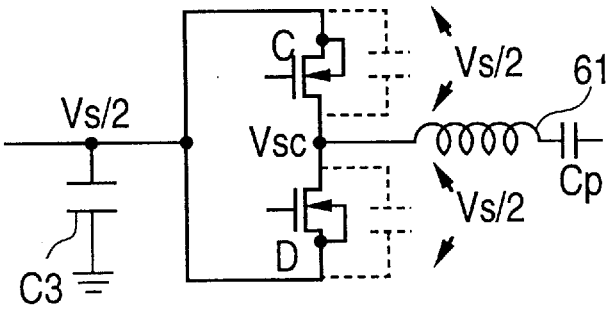
FIG. 6B (PRIOR ART)
Figure 6C:
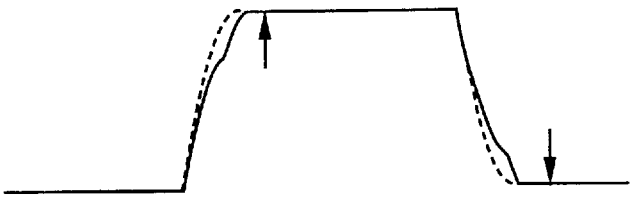
FIG. 6C (PRIOR ART)

FIGS. 6A to 6C are diagrams for explaining an underlying problem of the power save circuit to be connected to the X electrode which is shown in FIG. 5.

For applying a voltage so that the potential at the X electrode will vary between 0 V and a Vs level, a voltage Vs/2 is accumulated in the capacitor C3. When the potential at the X electrode is varied from 0 V to the Vs level, as shown in FIG. 6A, the potential across the coil 61 is 0 V. In this state, when the transistor C is brought to conduction, the voltage Vs/2 is applied from the capacitor C3 to one end of the coil 61. This causes a current to flow through the coil 61. The potential at the X electrode located at the other end of the coil 61 rises. Ideally, the potential at the X electrode rises to a Vs level that is higher by a Vs/2 level than a potential Vs/2 at the other end because of a counterelectromotive force developed in the coil 61. In practice, the potential will not rise to the Vs/2 level because of various losses. When the potential has risen to a level that is somewhat lower than the Vs level, a transistor A is brought to conduction so that the potential will rise to the Vs level. Likewise, for varying the potential at the X electrode from the Vs level to 0 V, as shown in FIG. 6B, the potential across the coil 61 has the Vs level. When the transistor D is brought to conduction, the potential of one end of the coil 61 becomes to Vs/2. The potential of the other end of the coil 61 becomes to Vs/2, then, the potential of the X electrode becomes 0 V because of the counterelectromotive force. After the potential at the other end of the coil 61 becomes the Vs/2 level, it rises again to the Vs level. Power is thus restored to the capacitor C3. Even in this case, when the potential has fallen to a level near 0 V, a transistor B is brought to conduction so that the potential will be lowered to 0 V. That is to say, the potential at the X electrode varies as indicated with a solid line in FIG. 6C. A dashed line indicates an ideal variation. A level by which the potential at the X electrode is raised using the transistor A and a level by which the potential of the X electrode is lowered using the transistor B become losses. This means that excess power is consumed. It is therefore required that the potential at the X electrode be raised and lowered as much as possible.

Raising and lowering the potential at the X electrode by means of the power save circuit is affected greatly by switching speeds of the transistors C and D. A higher switching speed makes it possible to raise or lower the potential at the X electrode more greatly. As shown in FIGS. 6A and 6B, the transistors C and D each have a parasitic capacitor. As shown in FIG. 6A, in a state in which the potential at the X electrode has not been varied from 0 V to the Vs level, the potential across the coil 61 is 0 V. The potential at the capacitor C3 has the Vs/2 level. The voltage Vs/2 is therefore applied to the parasitic capacitors of the transistors C and D. Consequently, charges are accumulated in the parasitic capacitors. For attaining the potential Vs/2 at the other end of the coil after the transistor C conducts, it is required to cancel out charges accumulated on the parasitic capacitors of the transistors C and D. In general, the parasitic capacitors of the transistors C and D are so large that canceling out charges accumulated on the parasitic capacitors causes the switching speeds to decrease. For this reason, the potential at the X electrode cannot be raised or lowered sufficiently. This results in a large power loss.

Moreover, a switching speed at which the potential at an electrode is changed poses another problem different from the foregoing one. FIGS. 7A to 7D are diagrams for explaining this problem.

Figure 7A:
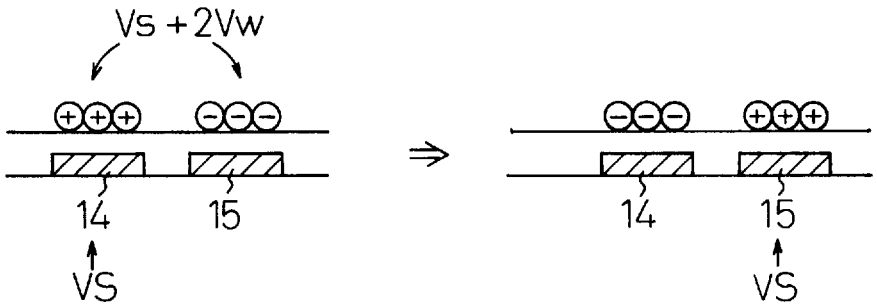
FIGS. 7A to 7D are diagrams for explaining the influence of a switching speed.

As already described, the PDP display achieves discharge by applying a voltage of opposite polarity alternately to the common electrode 14 (X electrode) and scan electrodes (Y electrodes) 15 during a sustaining discharge period. As shown in FIG. 7A, addressing discharge carried out during a scanning period causes charges of opposite polarities to be accumulated on the surfaces of the common electrode 14 and scan electrodes 15 respectively. Wall voltages induced by the accumulated charges shall have a Vw level. When a sustaining discharge voltage Vs is applied to one of the common electrode and scan electrodes, it means that a voltage Vs+2 Vw has been applied to the common electrode 14 and scan electrodes 15. Sustaining discharge is then carried out. The sustaining discharge causes the charges on the surfaces over the common electrode 14 and scan electrodes 15 to shift to the surface over one of the electrodes 14 and 15. When all the charges have shifted, the sustaining discharge voltage Vsc is applied to the other electrode or electrodes. A phenomenon inverse to the foregoing one ensues. The charges shift in an opposite direction. As this procedure is repeated, sustaining discharge is carried out. For repeating sustaining discharge in the same fashion, it is required that all the charges accumulated over one of the common electrode and scan electrodes shift to the other. If any of the charges does not shift, the wall voltage Vw falls and the discharge strength decreases.

Figure 7B:
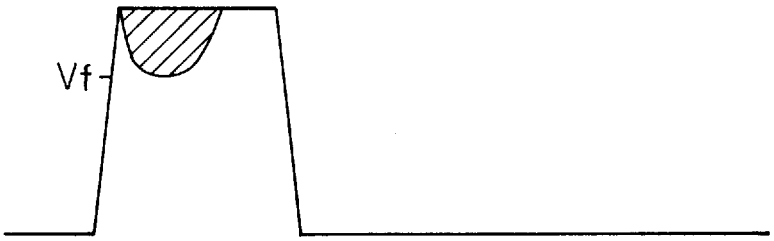
Figure 7C:
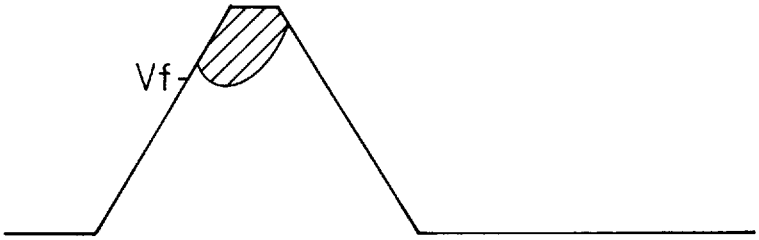

If a switching speed at which the potential at an electrode is changed is high, as shown in FIG. 7B, the voltage (a total voltage of paired electrodes) of a cell reaches a threshold voltage Vf before the potential at the electrode rises. However, discharge is not started immediately but started with delay. In practice, discharge is started when the voltage of the cell is almost set to a voltage fixed by clamping. By contrast, if the switching speed at which the potential at an electrode is changed is low, as shown in FIG. 7C, there is time before the voltage of the cell becomes the voltage fixed by clamping after it reaches the threshold voltage Vg. Discharge therefore starts before the voltage of the cell becomes the voltage fixed by clamping. When such discharge occurs, a problem occurs; that is, charges accumulated over one of the paired electrodes of the cell do not shift to the other electrode but become losses. When such discharge is repeated, wall charges decrease in magnitude. This brings about a decrease in discharge strength. It is therefore required that the switching speed at which the potential at an electrode is changed be rather high.

Figure 7D:
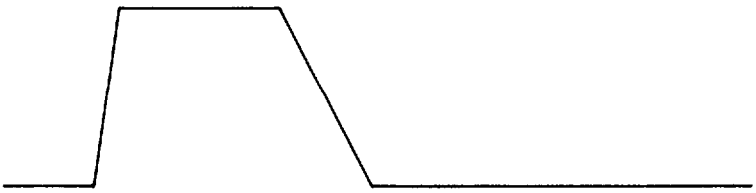

A current that flows with switching of the potential at an electrode is expressed as the differential of a voltage relative to a time. The more violent a variation is, the larger the flowing current is. A power save circuit, drive circuits, and electrodes each have a resistance. A power consumption due to a resistance is proportional to the second power of the current. The higher a switching speed at which the potential at an electrode is changed is, the larger the power consumption due to a resistance is. That means that it is required to determine the switching speed, at which the potential at an electrode is changed, in consideration of two mutually contradictory factors. In some situation, it is preferable that for example, as shown in FIG. 7D, application of power be made quick and restoration be made less quick.

Figure 8:
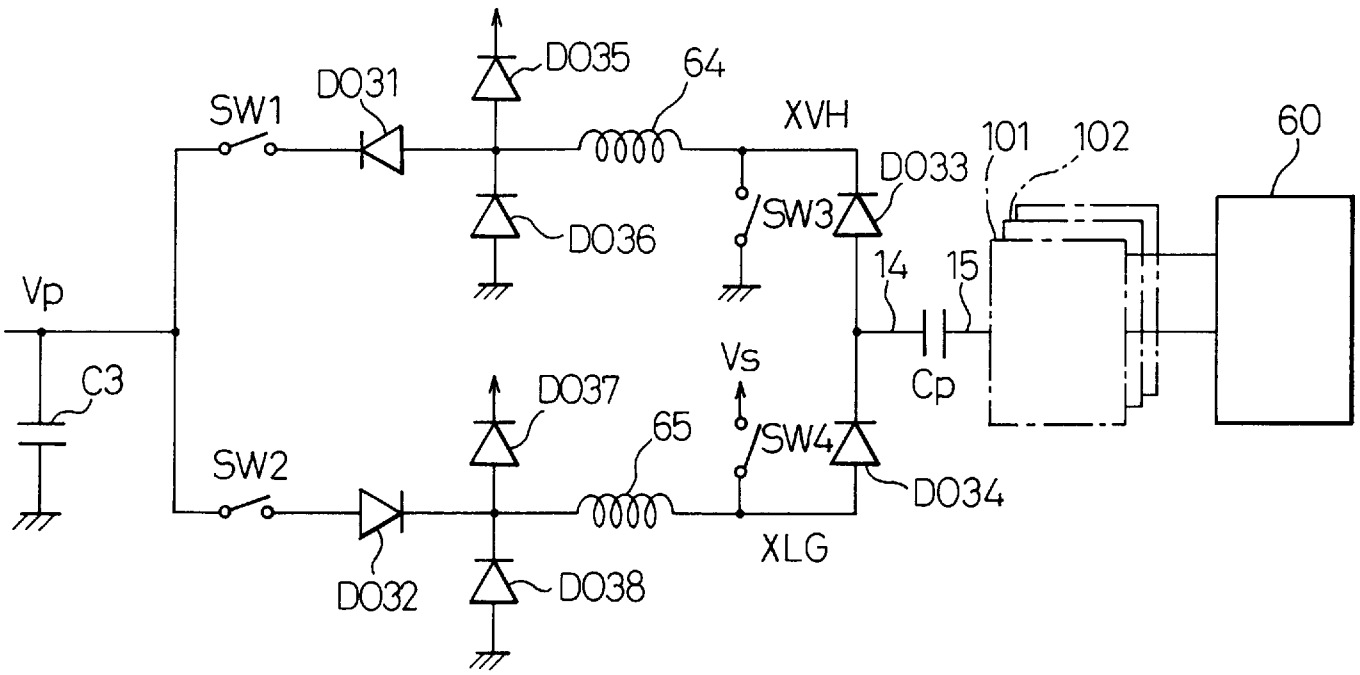
FIG. 8 is a diagram showing the basic circuitry of a power save circuit in accordance with the present invention.

FIG. 8 is a diagram showing the principles and constituent features of the present invention.

In FIG. 8, reference numeral Cp denotes a capacitor that is a panel. 14 and 15 denote a pair of electrodes formed on one substrate and involved in discharge glow. 14 denote a common electrode, and 15 denotes a scan electrode. The common electrode 14 is equivalent to the X electrode, and the scan electrode 15 is equivalent to one Y electrode. 101, 102, etc. denote scan electrode drive circuits. 60 denotes a power save circuit connected to the scan electrode drive circuits. C3 denotes a capacitive element designed for accumulation.

As illustrated, a common electrode drive circuit and power save circuit are divided into two channels; a restoration channel XVH and application channel XLG. Inductance elements 64 and 65 are connected on the respective channels. Each of the inductance elements 64 and 65 constitutes a resonant circuit together with the panel capacitor Cp.

Switches SW3 and SW4 are elements constituting the drive circuit for the common electrode 14. In a conventional drive circuit not having a power save circuit, these switches are used to drive the common electrode 14. The switch SW3 switches over the restoration channel XVH to a low-potential terminal when power applied to the common electrode 14 is restored. The switch SW4 switches over the application channel XLG to a high-potential terminal when accumulated power is applied to the common electrode 14.

SW1 and SW2 denote switches comparable to the transistors C and D included in the single-system power save circuit shown in FIG. 5. The switch SW1 is connected on the restoration channel XVH, while the switch SW2 is connected on the application channel XLG.

DO31 and DO32 denote diodes connected on the restoration channel XVH and application channel XLG respectively and designed to block currents flowing in opposite directions. However, the diodes need not always be included.

DO33 and DO34 denote diodes connected on the restoration channel XVH and application channel XLG respectively and designed to block currents flowing in opposite directions. However, the diodes need not always be included, either.

The pairs of diodes DO35 and DO36 and diodes DO37 and DO38 are reset diodes biased inversely and connected on the restoration channel XVH and application channel XLG to a high-potential terminal and low-potential terminal. These diodes operate in cooperation with the switches SW3 and SW4 so as to nullify voltage differences occurring across inductance elements 64 and 65 respectively by restoring power supplied to the common electrode 14 to the power save circuit or by applying accumulated power to the common electrode 14.

The switches SW1, SW2, SW3, and SW4 can be realized with field-effect transistors. The switches SW1 and SW2 may be realized with insulated-gate bipolar transistors (IGBTs). In this case, even if the diodes DO31 and DO32 are not included, efficiency or the like will not deteriorate.

The inductances of the inductance elements 64 and 65 may be differentiated from each other. It is preferable that the inductance of the inductance element 64 be larger than that of the inductance element 65.

It is also preferable to connect a dual-system power save circuit on the side of scan electrodes. A scan drive circuit for driving an associated scan electrode may be of a floating type in which a drive switch is interposed between the scan electrode and the restoration channel or application channel and a diode is placed in parallel with the drive switch, or of a diode mixing type in which a diode alone is connected between the scan electrode and the restoration channel or application channel and a drive switch is connected between the scan electrode and another power terminal.

In the present invention, a power save circuit is divided into two channels; a restoration channel XVH and an application channel XLG. The parasitic capacitor of one of transistors serving as switches SW1 and SW2 does not affect the switching speed of the other transistor on the other channel. What affects the switching speed is only the parasitic capacitor of the one transistor constituting a switch on a channel concerned. This results in the halved influence of the parasitic capacitor and the accordingly improved switching speed. Consequently, the potential at the X electrode can be raised or lowered sufficiently. Eventually, a power loss can be reduced.

The switching speed at which the potential at an electrode is changed is determined by various kinds of factors such as the driving ability of a transistor or a resistance on a channel. An inductance element constitutes a resonant circuit in cooperation with a capacitor Cp that is a panel. Since the resonant frequency of the resonant circuit is determined with an inductance, it is affected greatly by the inductance of the inductance element. When a power restoration circuit is composed of two channels and the channels each have an inductance element as they do in the present invention, if inductance elements having different inductances are used, it becomes possible to change switching speeds between power restoration and application. For example, as shown in FIG. 7D, it is possible to carry out power application fast and restoration less fast.

Figure 9:
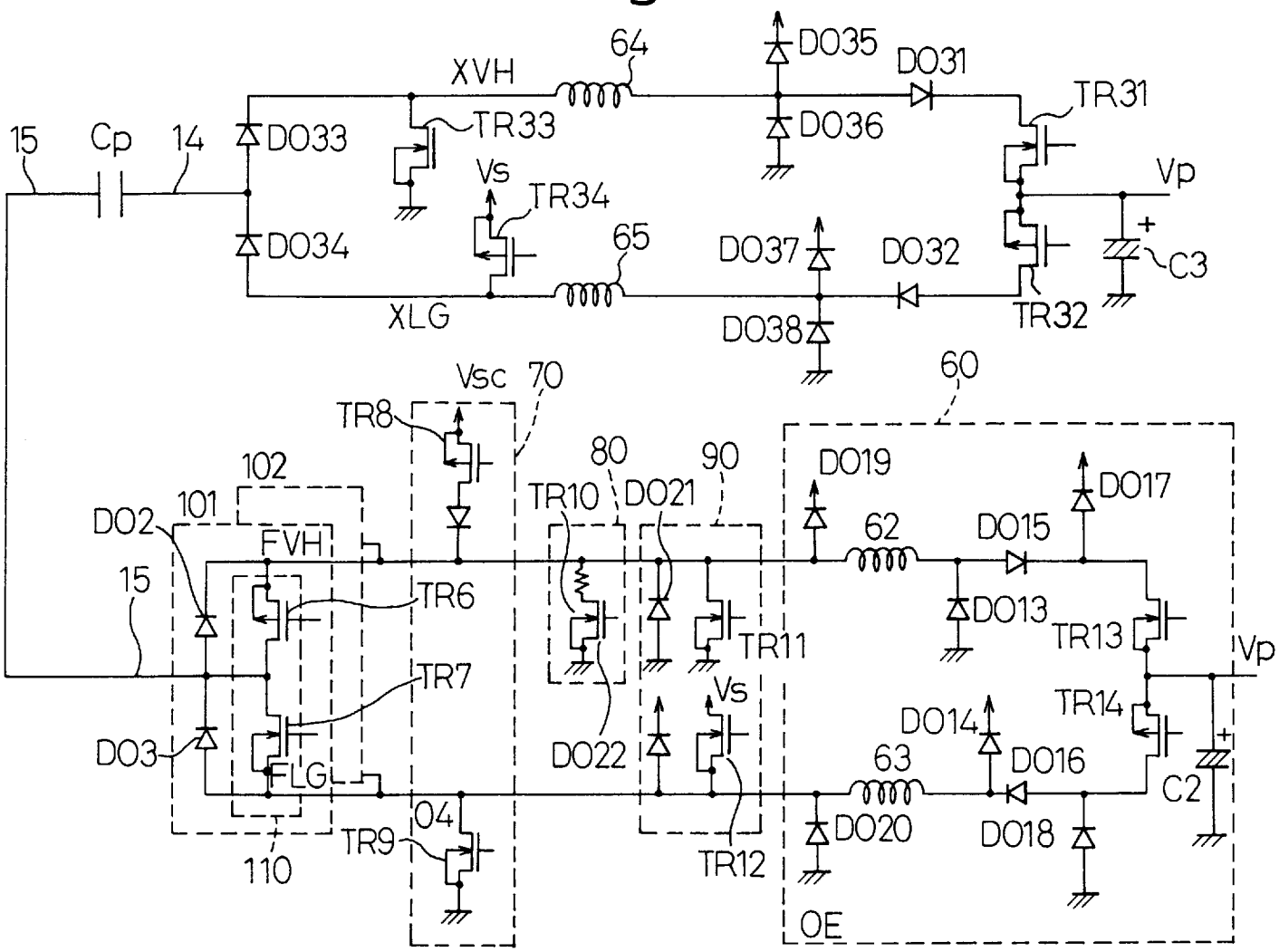
FIG. 9 is a diagram showing the circuitry of a drive unit for a PDP display of the first embodiment.

FIG. 9 is a diagram showing the circuitry of a drive unit for a PDP display of the first embodiment. The PDP display is a triple-electrode PDP display shown in FIGS. 1 and 2. The drive unit therefore includes address drivers 6. Since the address driver is identical to a conventional one, it is not illustrated. The description of the address driver will be omitted.

In FIG. 9, reference numeral Cp denotes a capacitor Cp that is a panel. 14 denotes an X electrode, that is, a common electrode. 15 denotes a Y electrode, that is, one scan electrode. Circuits connected to the X electrode 14 are an X electrode drive circuit and its power save circuit. Circuits connected to the Y electrode 15 are a Y electrode drive circuit and its power save circuit.

As shown in FIG. 9, the X electrode drive circuit and power save circuit are composed of two channels; a restoration channel XVH and application channel XLG. On the restoration channel XVH, a diode DO33, coil 64, diode DO31, and transistor TR31 are connected in that order from the panel capacitor Cp. The other controlled electrode of the transistor TR31 is connected to a capacitor C3. The diodes DO33 and DO31 are connected with the direction toward the capacitor C3 regarded as a forward direction. A transistor TR33 is connected between a junction between the diode DO33 and coil 64 and a ground. A junction between the coil 64 and diode DO31 is connected to a power supply Vs via a diode DO35, and grounded via a diode DO36. On the application channel XLG, a diode DO34, coil 65, diode DO32, and transistor TR32 are connected in that order from the panel capacitor Cp. The other controlled electrode of the transistor TR32 is connected to the capacitor C3. The diodes DO34 and DO32 are connected with the direction from the capacitor C3 toward the panel capacitor Cp regarded as a forward direction. A transistor TR34 is connected between a junction between the diode DO34 and coil 64 and the power supply Vs. A junction between the coil 65 and diode DO32 is connected to the power supply Vs via a diode DO37, and grounded via a diode DO38. The transistors TR31 and TR32 correspond to the switches SW1 and SW2 in FIG. 8. The transistors TR33 and TR34 correspond to the switches SW3 and SW4 in FIG. 1. The transistors are turned on or off with a signal sent from a control unit that is not shown. The transistors are all field-effect transistors (FETs). The coils 64 and 65 realize inductance elements shown in FIG. 8. The diodes DO35 to DO38 are used to make a remaining difference of potentials of both ends of the coils 64 and 65.

The Y electrode drive circuit and power save circuit have the circuit identical to that of the floating type, which is shown in FIG. 5, disclosed in Japanese Unexamined Patent Publication No. 7-160219. A brief description will be made of the Y electrode drive circuit and power save circuit. The Y electrode drive circuit and power save circuit are divided into two channels; a restoration channel FVH and application channel FLG.

Reference numerals 101 an 102 denote drive circuits connected to associated Y electrodes. Each drive circuit has a diode DO2 and transistor TR6 connected between the associated Y electrode and restoration channel FVH and a diode DO3 and a transistor TR7 connected between the Y electrode and application channel FLG. The transistors TR6 and TR7 constitute a push-pull circuit 110. For example, when a scanning pulse is a pulse varying from a Vsc level to a ground level, the transistors TR6 and TR7 included in the drive circuit connected to a Y electrode to which the scanning pulse is applied are turned off and on respectively. The transistors TR6 and TR7 in the drive circuits connected to Y electrodes other than the Y electrode to which the scanning pulse is applied are turned on and off respectively.

On the restoration channel FVH and application channel FLG, circuit elements such as those illustrated are connected. A block denoted by reference numeral 70 is a block used to set the restoration channel FVH to the scanning voltage level Vsc and the application channel FLG to the ground level during a scanning period. During a scanning period, the transistors TR8 and TR9 are turned on. During the other periods, these transistors are turned off. A block denoted by reference numeral 80 is a leakage circuit used to eliminate the scanning voltage Vsc remaining on the restoration channel FVH at the transition from the scanning period to a sustaining discharge period. A block denoted by reference numeral 90 is a clamping circuit for setting the application channel FLG to a sustaining discharge voltage level Vs and the restoration channel FVH to the ground level. As described later, the transistors TR11 and TR12 are turned on and off alternately. A block denoted by reference numeral 60 is a power save circuit.

Figure 10:
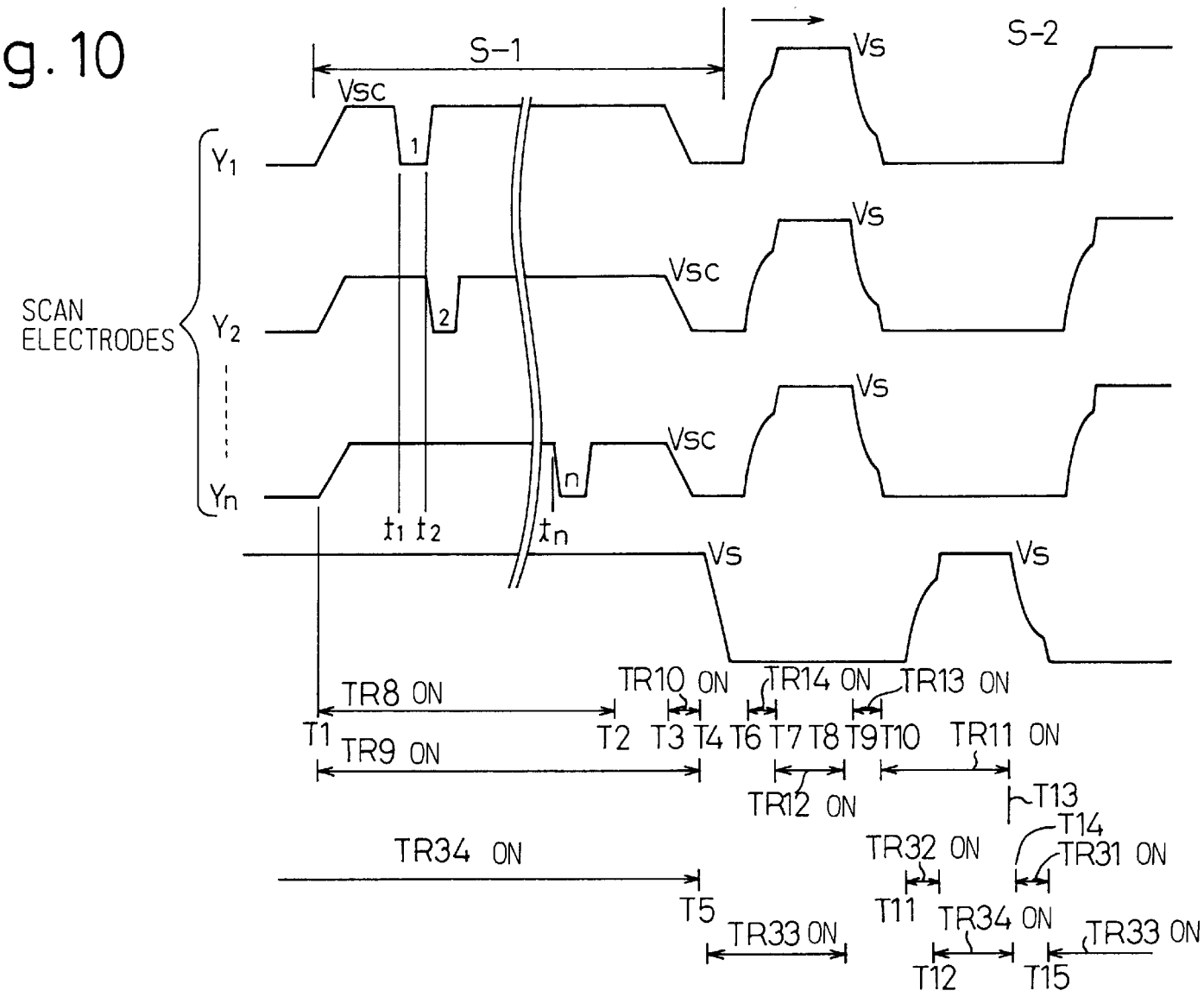
FIG. 10 is a timing chart showing the operations of a PDP display driven by the drive unit of the first embodiment.

FIG. 10 is a timing chart showing the operations of drive circuits in the first embodiment shown in FIG. 9. Referring to FIG. 5, the operations of the circuits shown in FIG. 9 will be described. In FIG. 10, a signal for driving address electrodes is omitted.

As shown in FIG. 10, immediately before a scanning addressing period S-1 starts, the transistor TR6 in the scan drive circuit 101 that is a scan drive circuit for a Y electrode 15 is turned on, and the transistors TR8 and TR9 are turned on at the same time. The restoration channel and application channel FVH and FLG connected to the drive circuit for driving the Y electrode 15 are set to a Vsc level. As a result, individual Y electrodes are charged rapidly to the Vsc level. In the meantime, the transistor TR34 in the X electrode drive circuit remains on. A voltage Vs is applied to the X electrode. The state in which the voltage Vs is applied to the X electrode 14 and the state in which the restoration channel and application channel FVH and FLG are set to the Vsc level are retained until the scanning addressing period S-1 is about to end.

The Y electrodes are, as mentioned above, charged to the Vsc level. First, the transistor TR7 of the push-pull circuit which is connected on the application channel FLGl connected to the drive circuit 101 for driving the first Y electrode 15-1 is turned on, and the transistor TR6 of the push-pull circuit is turned off. This causes the potential at the Y electrode to fall to the ground level. During the time interval t1–t2, address outputs corresponding to display data coincident with the Y electrode 15-1 are applied by an appropriate address driver 6. Thus, data is written. In this data writing, cells 10 over the Y electrode 15-1 which are selected according to the address data are discharged. A given wall charge is then developed in each of the cells 10. In the cells 10 in which discharge has occurred, the discharge ceases due to the wall charges of the cells 10. Consequently, address data writing is terminated. In the meantime, the transistors TR6 that is ones of the push-pull circuits in the drive circuits for driving the other Y electrodes 15-2 to 15-n are on.

The foregoing scan is executed for the respective Y electrodes 15-2 to 15-n. At time instant T2 at which the scanning addressing period S-1 is about to end, the transistor TR8 is turned off. At time instant T3 after a given time has elapsed, the transistor TR10 of the leakage circuit is turned on. In this state, the transistor TR9 is on. At time instant T4, a high voltage Vsc used to charge the power lines FVH and FLG connected to drive circuits for driving the Y electrodes is dissipated to the ground through the transistor TR10. The potentials on the restoration channel and application channel FVH and FLG therefore become 0 V. The transistor TR9 is also turned off at time instant T4. At the same time, the transistor TR34 in the X electrode drive circuit is turned off at time instant T4. Thus, the scanning addressing period S-1 comes to an end.

In short, the potentials at Y electrode drive circuits are set to 0 V, and all the Y electrodes are set to 0 V via the diodes DO2 at the same time. Furthermore, the potentials at the restoration channels and application channels FVH and FLG are set to 0 V. Thus, a series of operations to be performed during a scanning period is terminated. At this time, a voltage Vs is applied to the X electrode drive circuit for fear discharge be increased lengthwise or in magnitude.

Next, during a sustaining discharge period S-2, cells 10 discharged during the scanning addressing period have wall charges left intact. By utilizing the wall charges, an alternating voltage is applied alternately to the paired electrodes of each of the cells having the remaining wall charges. Discharge is thus repeated, whereby display is achieved. For sustaining discharge, the same alternating voltage is applied simultaneously to all the Y electrodes.

First, at the start of the sustaining discharge period, a given voltage Vs is applied to the Y electrodes. At time instant T5, the transistor TR33 in the X electrode drive circuit is turned on. The X electrode is retained at 0 V. Thereafter, at time instant T6, the transistor TR14 included in the power save circuit 60 is turned on. The application channel FLG is charged with part of power accumulated on the capacitor C2. This causes the potential on the application channel FLG connected to the drive circuits for driving the Y electrodes to rise. If the charges on the capacitor C2 are sufficient, the potential on the application channel FLG connected to the drive circuits for driving the Y electrodes rises to a given voltage level Vs. In general, the potential will not rise to the Vs level. At time instant T7, the transistor TR14 is turned off, and the transistor TR12 is turned on at the same time. The potential on the application channel FLG is thus raised to the Vs level. The voltage Vs is applied to the cells 10 in the display panel via the diodes DO3.

At time instant T8, the transistor TR12 is turned off, and the transistor TR33 in the X electrode drive circuit is turned off at the same time. Thereafter, at time instant T9, the transistor TR13 in the power save circuit 60 is turned on. Part of the voltage Vs used to charge the Y electrodes 15 is led into the capacitor C2 and accumulated in the capacitor C2. The charges are used to charge the Y electrodes subsequently. With this operation, the potential on the restoration channel FVH falls rapidly. At time instant T10, the transistor TR13 is turned off, and the transistor TR11 is turned on at the same time. The potential on the restoration channel FVH is lowered completely to 0 V.

On the side of the X electrode, the transistor TR32 is turned on at time instant T11 during a time interval during which the transistor TR11 is on. The potential at the X electrode 14 is raised via the coil 61. At time instant T12, the transistor TR32 is turned off, and the transistor TR34 is turned on at the same time. This causes the potential at the X electrode 14 to rise to the given voltage level Vs. Meanwhile, the potentials at the Y electrodes are retained at 0 V, which is a voltage of the ground, via the diode DO2.

Thereafter, at time instant T3, the transistor TR11 and transistor TR13 are turned off simultaneously. At time instant T14, the transistor TR31 is turned on. This causes the potential at the X electrode 14 to rise. Part of charges accumulated on the cells 10 is used to charge the capacitor C3. When the potential at the X electrode 14 has fallen to some extent, the transistor TR33 is turned on. This causes the potential at the X electrode 14 to fall to 0 V. Thus, one cycle of sustaining discharge operations is completed.

Thereafter, the foregoing operations are repeated a given number of times. Given cells 10 in the display panel are allowed to glow at a given luminance. The luminance level at each cell 10 is determined with the frequency of applying an alternating voltage during a sustaining discharge period.

When the foregoing display operations are completed, the wall charges on all the cells 10 are reduced by initialization. Operations are then carried out in order to handle the next frame.

Figure 11:
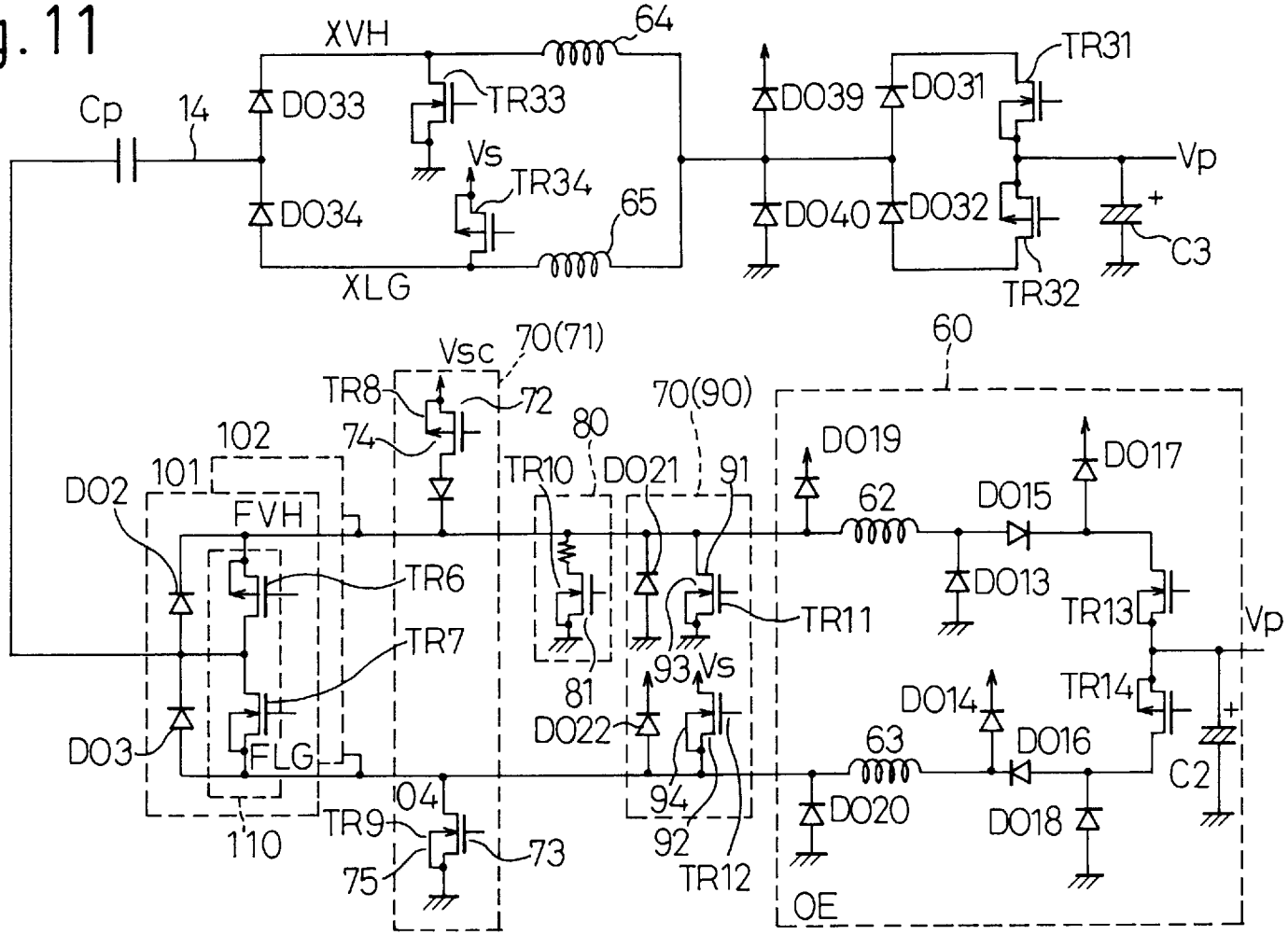
FIG. 11 is a diagram showing the circuitry of a drive unit for a PDP display of the second embodiment.

FIG. 11 is a diagram showing the circuitry of a drive unit for a PDP display of the second embodiment. As apparent from comparison with FIG. 9, the drive unit for a PDP display of the second embodiment has substantially the same circuitry as that of the first embodiment. A difference lies in that a restoration channel XVH and application channel XLG partly share the same channel.

A diode DO39 connected to the power supply Vs and designed to nullify a remaining inductance and a diode DO40 grounded are connected on the common channel and shared by the restoration channel and application channel. This circuitry contributes to a reduction in number of parts.

In the drive unit of the second embodiment, the transistors TR31 and TR32 operating as switches for switching over channels to the capacitor C3 that accumulates restored power are connected via the diodes DO31 and DO32. The connection direction of the diodes DO31 and DO32 is a forward direction. Since a direction in which a current flows from the transistor TR32 to the transistor TR31 is the forward direction, the parasitic capacitors of the transistors TR31 and TR32 do not affect the switching speed of the transistor TR31 being turned from off to on, but it affects the switching speed of the transistor TR32 being turned from off to on. It therefore cannot be said that it has been accomplished satisfactorily to reduce the influence of the parasitic capacitors for the purpose of improving a switching speed and to set a voltage, which should be attained to apply restored power to the X electrode 14, to a high level for the purpose of reducing a power consumption. However, since two coils are connected one by one on the respective channels, it is possible to mutually differentiate the inductances of the coils so that a switching speed can be different between power restoration and application.

The operations of the drive unit for a PDP display of the second embodiment are identical to those of the first embodiment described in conjunction with the timing chart of FIG. 10.

Figure 12:
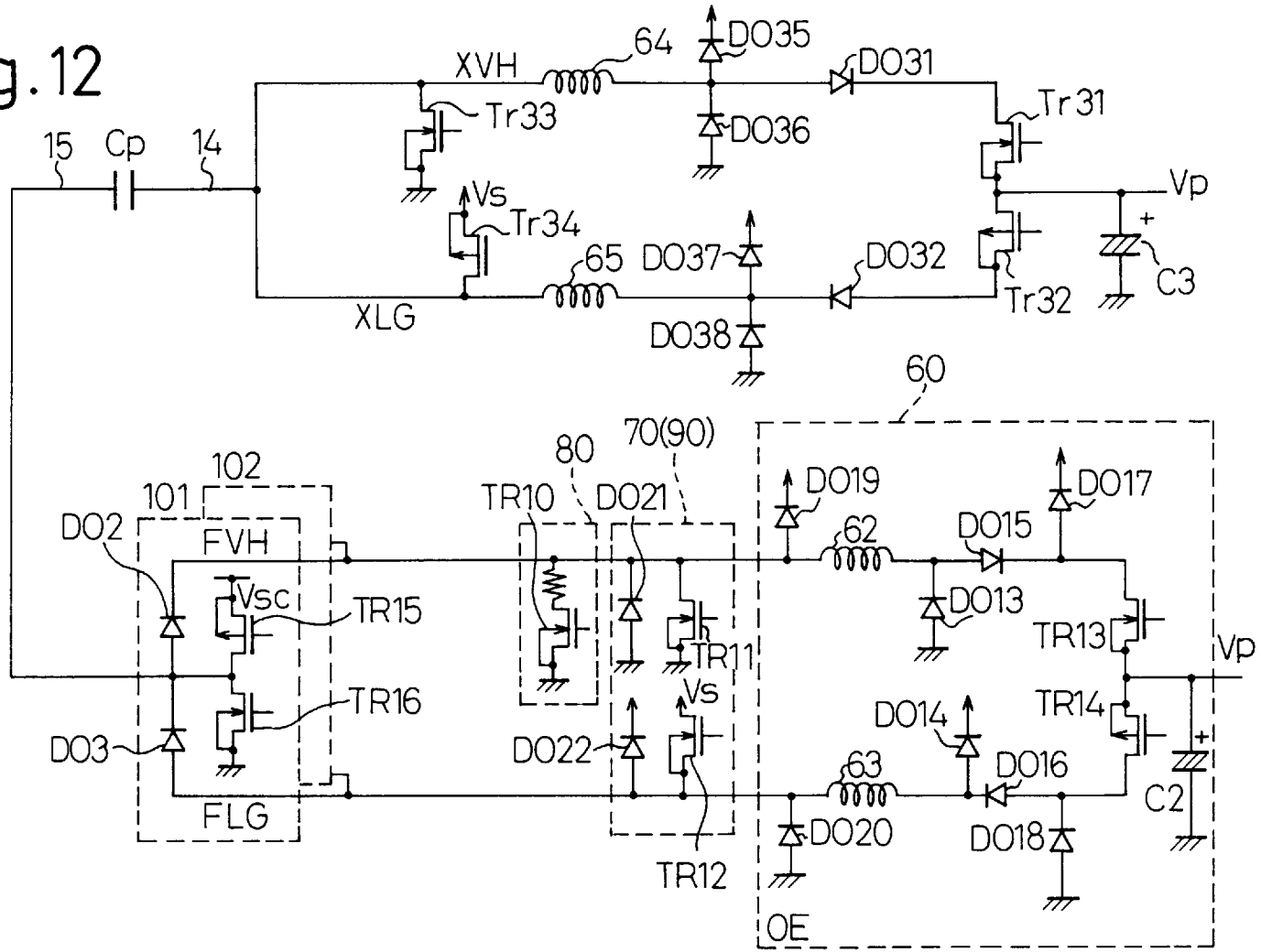
FIG. 12 is a diagram showing the circuitry of a drive unit for a PDP display of the third embodiment.

FIG. 12 is a diagram showing the circuitry of a drive unit for a PDP display of the third embodiment.

As apparent from comparison with FIG. 9, the drive unit for a PDP display of the third embodiment has substantially the same circuitry as that of the first embodiment. Differences lie in that the diodes DO33 and DO34 in the X electrode drive circuit and the scan voltage application circuit 70 connected to Y electrode drive circuits are excluded, and in the Y electrode drive circuits.

Since the diodes DO33 and DO34 are excluded, the coils 64 and 65 are always made. When the potential at a junction with the X electrode 14 varies, the potentials across both the coils vary. However, since the diodes DO31 and DO32 are included, almost no current flows into a coil on a channel that is not operating. The influence of the coil is therefore minor. Unlike that of the first embodiment, this drive unit just undergoes slight deterioration of efficiency.

In each Y electrode drive circuit, a transistor TR15 is connected between an associated Y electrode 15 and a power supply for supplying a scan voltage Vsc, and a transistor TR16 is connected between the Y electrode 15 and a ground. Diodes DO2 and DO3 are connected between the Y electrode 15 and a restoration channel FVH and between the Y electrode 15 and an application channel FLG respectively. During an addressing scan period, the transistors TR15 and TR16 apply a scanning pulse directly to an associated Y electrode. The scan voltage applying circuit 70 is therefore unnecessary. This kind of circuit is referred to as a diode mixing type circuit.

The operations of the drive unit for a PDP display of the second embodiment are identical to those of the one of the first embodiment described in conjunction with the timing chart of FIG. 10.

In the aforesaid first to third embodiments, all the transistors operating as switches are MOSFETs (metal-oxide-semiconductor field-effect transistors). This is because the operating speed of a MOSFET is usually higher than that of a bipolar transistor. In recent years, what is referred to as an insulated-gate bipolar transistor (IGBT) and has an excellent conducting characteristic that is a feature of a bipolar transistor while possessing characteristics equivalent to those of a MOSFET in terms of the operating speed, peak current, and the like has come to be used.

Figure 13:
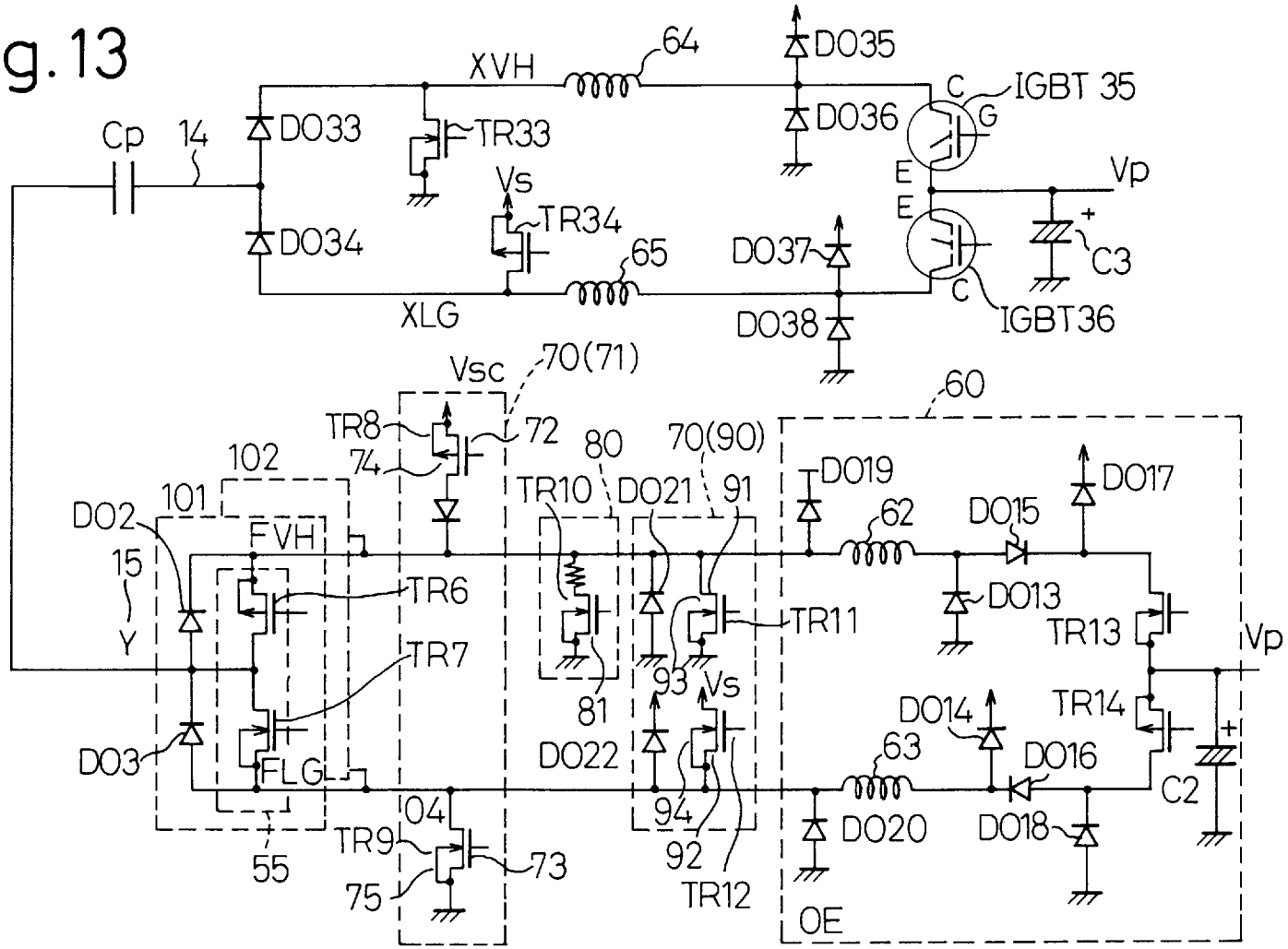
FIG. 13 is a diagram showing the circuitry of a drive unit for a PDP display of the fourth embodiment.

FIG. 13 is a diagram showing the circuitry of a drive unit for a PDP display of the fourth embodiment.

As apparent from comparison with FIG. 9, the drive unit for a PDP display of the third embodiment has substantially the same circuitry as that of the first embodiment. Differences lie in that insulated-gate bipolar transistors IGBT35 and IGBT36 are substituted for the transistors TR31 and TR32, and that the diodes DO31 and DO32 are excluded. As mentioned above, an insulated-gate bipolar transistor has characteristics equivalent to or better than a MOSFET in terms of necessary items. A more efficient power save circuit can therefore be materialized. The circuit devoid of the diodes DO31 and DO32 still operates as a power save circuit. No particular problem occurs.

As described so far, according to the present invention, in a triple-electrode planar display a power save circuit having two channels and being capable of saving power efficiently can be connected to an X electrode, which is one of a pair of electrodes of each cell responsible for sustaining discharge. Eventually, further power saving can be accomplished.

I claim:

1. A drive unit for a planar display having a display panel, in which electrodes are placed between two substrates being arranged with a given space between them, in which a plurality of intersections formed by said electrodes form cells that constitute pixels and that are arranged in the form of a matrix, in which said cell is composed of an electrode formed on one of said two substrates and a pair of electrodes formed on the other substrate, and in which one of the pair of electrodes is a common electrode connected in common, said drive unit for a planar display comprising:

a common electrode drive circuit for changing said common electrode alternately into a high potential and low potential; and a power save circuit that when said common electrode is changed from the high potential to the low potential, restores and accumulates power applied to said common electrode, and that when said common electrode is changed from the low potential to the high potential, applies accumulated power to said common electrode, said power save circuit including:

a capacitive element for accumulating restored power;

a restoration channel that includes an inductance element, that is connected between said capacitive element and said common electrode, and that when said common electrode is changed from the high potential to the low potential, restores power applied to said common electrode; and an application channel that includes an inductance element, that is connected in parallel with said restoration channel between said capacitive element and said common electrode, that when said common electrode is changed from the low potential to the high potential, applies accumulated power to said common electrode.

2. A drive unit for a planar display according to claim 1, said common electrode drive circuit includes:

a third switch that is connected on said restoration channel and interposed between said common electrode and said inductance element, that when power applied to said common electrode is restored, switches over said restoration channel to said low-potential terminal; and a fourth switch that is connected on said application channel and interposed between said common electrode and said inductance element, and that when accumulated power is applied to said common electrode, switches over said application channel to said high-potential terminal.

3. A drive unit for a planar display according to claim 2, wherein said third switch and fourth switch are field-effect transistors.

4. A drive unit for a planar display according to claim 1, wherein:

on said restoration channel, a first diode for passing a current flowing from said common electrode toward said capacitive element and blocking a current flowing in an opposite direction, and a first switch connected in series with said first diode are interposed between said capacitive element and said inductance element; and on said application channel, a second diode for passing a current flowing from said capacitive element toward said common electrode and blocking a current flowing in an opposite direction, and a second switch connected in series with said second diode are interposed between said capacitive element and said inductance element.

5. A drive unit for a planar display according to claim 4, wherein said first switch and said second switch are field-effect transistors.

6. A drive unit for a planar display according to claim 4, wherein said first switch and said second switch are insulated-gate bipolar transistors.

7. A drive unit for a planar display according to claim 1, wherein:

on said restoration channel, a first switch formed with an insulated-gate bipolar transistor is interposed between said capacitive element and said inductance element; and on said application channel, a second switch formed with an insulated-gate bipolar transistor is interposed between said capacitive element and said inductance element.

8. A drive unit for a planar display according to claim 1, wherein said restoration channel and said application channel include reset diodes that are biased inversely and connected to said high-potential terminal and said low-potential terminal.

9. A drive unit for a planar display according to claim 8, wherein said restoration channel and said application channel partly share the same channel, and reset diodes realized by sharing said reset diodes are connected on said common channel.

10. A drive unit for a planar display according to claim 4, wherein:

on said restoration channel, a third diode connected in the same direction as said first diode is interposed between said common electrode and said inductance element; and on said application channel, a fourth diode connected in the same direction as said second diode is interposed between said common electrode and said inductance element.

11. A drive unit for a planar display according to claim 1, wherein said inductance elements on said restoration channel and said application channel have different inductances.

12. A drive unit for a planar display according to claim 11, the inductance of said inductance element on said restoration channel is larger than that of said inductance element on said application channel.

13. A drive unit for a planar display according to claim 1, further comprising:

a plurality of scan drive circuits each of which drives a scan electrode that is one of said pair of electrodes, and includes a push-pull circuit;

a scan drive power circuit for alternately supplying a high voltage and low voltage to said plurality of scan drive circuits so that said scan electrodes can be changed alternately into a high potential and low potential; and a power save circuit that when said scan electrodes are changed from the high potential to the low potential, restores and accumulates power applied to said scan electrodes, and that when said scan electrodes are changed from the high potential to the low potential, applies accumulated power to said scan electrodes, said power save circuit including;

a capacitive element for accumulating restored power;

a restoration channel that includes an inductance element, that is connected between said capacitive element and said scan electrodes, that when said scan electrodes are changed from the high potential to the low potential, restores power applied to said scan electrodes; and a application channel that includes an inductance element, that is connected in parallel with said restoration channel between said capacitive element and said scan electrodes, and that when said scan electrodes are changed from the low potential to the high potential, applies accumulated power to said scan electrodes.

14. A drive unit for a planar display according to claim 13, wherein said scan drive circuits each include:

a first scan diode and first scan switch connected in parallel with each other between said restoration channel and an associated scan electrode; and a second scan diode and second scan switch connected in parallel with each other between said application channel and said associated scan electrode.

15. A drive unit for a planar display according to claim 13, wherein said scan drive circuits each include:

a first scan diode connected between said restoration channel and an associated scan electrode;

a first scan switch connected between a second high-potential power terminal and said associated scan electrode;

a second scan diode connected between said application channel and said associated scan electrode; and a second scan switch connected between a second low-potential power terminal and said associated scan electrode.

* * * * *

UNITED STATES PATENT AND TRADEMARK OFFICE

CERTIFICATE OF CORRECTION

PATENT NO.: 5,828,353
DATED : October 27, 1998
INVENTOR(S): Tomokatsu KISHI et al.

It is certified that error appears in the above-identified patent and that said Letters Patent is hereby corrected as shown below:

Col. 13, line 36, begin a new paragraph with "As apparent".

Col. 16, line 55, begin a new paragraph with "said".

Signed and Sealed this

Fourth Day of May, 1999

*Attest:*

*Attesting Officer*

Q. TODD DICKINSON

*Acting Commissioner of Patents and Trademarks*